US007150579B2

(12) United States Patent
Newton

(10) Patent No.: US 7,150,579 B2
(45) Date of Patent: Dec. 19, 2006

(54) POST MOUNTING ARRANGEMENT

(76) Inventor: John Reginald Newton, 18 Templand Park Allithwaite, Grange-Over-Sands LA11 7QS (GB)

( * ) Notice: Subject to any disclaimer, the term of this patent is extended or adjusted under 35 U.S.C. 154(b) by 0 days.

(21) Appl. No.: 10/521,525

(22) PCT Filed: Jul. 16, 2003

(86) PCT No.: PCT/GB03/03087

§ 371 (c)(1),
(2), (4) Date: Nov. 2, 2005

(87) PCT Pub. No.: WO2004/007844

PCT Pub. Date: Jan. 22, 2004

(65) Prior Publication Data

US 2006/0104715 A1 May 18, 2006

(30) Foreign Application Priority Data

Jul. 17, 2002 (GB) ..... 0216513.2

(51) Int. Cl.
*E01F 9/03* (2006.01)

(52) U.S. Cl. ..... 404/11; 40/607.06; 403/372

(58) Field of Classification Search ..... 40/607.05, 40/607.06, 607.11, 607.12; 404/9, 11; 403/366, 403/372

See application file for complete search history.

(56) References Cited

U.S. PATENT DOCUMENTS 1,799,314 A * 4/1931 Pfaff ..... 52/298
6,561,720 B1 * 5/2003 Wirth et al. ..... 403/280
7,052,201 B1 * 5/2006 Zivkovic ..... 404/11

FOREIGN PATENT DOCUMENTS

| | | |
|---|---|---|
| DE | 37 33 973 | * 4/1989 |
| DE | 38 11 401 | * 10/1989 |
| EP | 0 571 082 | * 11/1993 |
| FR | 2 641 557 | * 7/1990 |

* cited by examiner

*Primary Examiner*—Gary S. Hartmann
(74) *Attorney, Agent, or Firm*—Daniel B. Schein

(57) ABSTRACT

A post mounting arrangement for ground installation of a post comprising a tubular body portion (6) which is adapted to be installed into the ground and has an open end adapted to receive a post (2) to be supported. The open end of the tubular body portion comprises an enlarged flange portion defining a head portion (14) of the tubular main body portion (6). The head flange portion (14) includes a resilient retaining collar (12, 12') adapted to receive and engage the post, and a strengthening band (8). The head portion (14) comprises a first recess (22) defined therein within which the said collar (12, 12') is engaged and mounted, and a second recess (20) defined in the head portion adapted to receive the said strengthening band (8). The collar may comprise a shock absorbing element (12') having a groove (42) capable of receiving an expansion ring (44) to lock the element into place and seal it both to the post (2) and the head portion (14). Alternatively, the head portion (14) further comprises a separate cap (10) which is adapted to be fitted to and engages with said head portion (14) to enclose said recesses (20, 22) and secure said collar (12) and strengthening ring (8) within said recesses.

23 Claims, 8 Drawing Sheets

POST MOUNTING ARRANGEMENT

The present invention relates to a post mounting arrangement for, in particular, mounting and erecting items of street furniture for example pedestrian guard rails, street signs or the like. Specifically the present invention relates to a socket arrangement for mounting and securing a post into the ground.

Throughout the road network and in our towns and cities there are a variety of situations where signs and barriers are present which for their support rely on the use of poles fixed into the ground. This type of structure, by the very nature of its location, is very vulnerable to impact from vehicular traffic and where poles enter the ground they are highly susceptible to corrosion.

When an impact or severe corrosion occurs, the resultant damage normally necessitates the need to remove the pole, or series of poles, and replace it. As most poles are fixed into the ground in concrete, their replacement is time consuming, often involving shutting down sections of road or pavement with the associated inconvenience and the total cost is very expensive. Firstly, this invention seeks to provide a pole housing that can withstand the destructive impact to a pole without sustaining damage and which will then permit rapid replacement of the damaged pole, hence significantly reducing the cost, time and inconvenience caused by the construction work incurred in their replacement.

In any situation where there is an impact, the more energy that can be absorbed within the structure without reaching the failure load of the components, then the less will be the damage to the structures involved. In situations where the poles form part of a crash barrier or guard rail system, it becomes a significant advantage if within the system there are provided specific components which absorb impact energy.

The conventional method and arrangement for installing a post is to dig a suitably sized hole at the installation site. The base of the post is placed into this hole and the remainder of the hole surrounding the post is filled in with concrete. The concrete sets and the post is thereby rigidly and permanently retained in the ground.

A problem with this arrangement is that the post is permanently fixed into the ground. Should the post become damaged (for example by being hit by a vehicle, etc.) and need to be replaced, the concrete needs to be broken up and removed. A new post then needs to be fitted and fresh concrete poured into the hole and allowed to set to fix the new post. This can take a considerable amount of time and can be difficult.

Alternative arrangements have been proposed, and are described in WO 92/20889 and WO 96/02704. In these arrangement a separate socket, comprising a tubular sleeve, is installed into the ground. The base of the post is then installed into the sleeve. A retaining portion, for example a resilient collar, of the sleeve releasably secures the post within the sleeve and so to the ground by virtue of an interference fit and frictional engagement of the post and sleeve. The sleeve is typically made from a plastics material such that it is resistance to corrosion. In order to strengthen the sleeve, in particular at the upper end where in use the bending stresses are at their greatest the sleeve may include a strengthening ring embedded and formed into the sleeve.

With such an arrangement the post can be more easily replaced in the event of damage by extracting the post from the socket/sleeve, and inserting a new post into the socket sleeve, without the need to dig up the ground surrounding the installation site. A problem with such an arrangement however is that the post can also be undesirably removed for example by vandals extracting the post from the socket. Whilst increasing the interference fit between the socket and post can make removal by vandals more difficult it will also inherently with this arrangement make removal, and installation of the post within the socket by authorised users replacing the post, more difficult.

Also in some cases when the post, or street furniture, is damaged for example following impact by a vehicle, the socket and in particular the embedded strengthening ring can be damaged. In such a case if the strengthening ring is damaged the socket needs to be removed and replaced by digging up the ground and breaking up the concrete within which the sleeve is affixed in a similar manner to that with conventional direct fixing and concreting in of the post. This obviates the advantages of the sleeve/socket arrangement.

The manufacture of an embedded strengthening ring within the moulded plastic sleeve/socket is also difficult and problematic. This undesirably increases costs.

It is therefore desirable to provide an improved post mounting arrangement for ground installation of a post which addresses the above described problems and/or which offers improvements generally. The invention seeks to provide a pole housing which is capable of absorbing impact energy, the amount of which can be tailored to some extent to match the specific application of the housing, and which is easily replaceable by authorised persons.

According to the present invention there is provided a post mounting arrangement and method of erecting a post as set out in the accompanying claims.

In an embodiment of the invention there is provided a post mounting arrangement for ground installation of a post comprising a tubular body portion which is adapted to be installed into the ground and has an open end adapted to receive a post to be supported. The open end of the tubular body portion comprises an enlarged flange portion defining a head portion of the tubular main body portion. The head flange portion includes a resilient retaining collar adapted to receive and engage the post, and a strengthening band. The head portion comprises a first recess defined therein within which the said collar is engaged and mounted, and a second recess defined in the head portion outwardly of said first recess and adapted to receive the said strengthening band. The head portion further comprises a separate cap which is adapted to be fitted to and engages with said head portion to enclose said recesses and secure said collar and strengthening ring within said recesses.

With such an arrangement, and the securing of the collar by the separate cap, the collar can be arranged to more securely grip the post to prevent unauthorised removal of the post whilst the post can be easily removed, when required by removal of the cap to release the collar. Furthermore by locating the collar and strengthening band in the said recesses and then securing them in place using a separate cap, the strengthening band and collar of the assembly can be disassembled and the strengthening band and collar individually replaced in the event of damage without having to remove the entire socket from the ground. The use of a separate cap, collar and in particular strengthening band located in the socket and secured in the socket by the cap, is also easier (and cheaper) to fabricate than some of the prior proposals in which these components are integrally fabricated and/or embedded within the socket assembly.

The cap when engaged and fitted to the head portion is preferably adapted to urge the collar inwards, in use, into engagement with the post. Furthermore said first recess defined in said head portion is preferably adapted such that said collar can flex away from, in use, engagement with said post. The cap accordingly includes a portion which is adapted, when said cap is fitted to said head portion, cooperates with said first recess to urge said collar, in use, into engagement with said post. The cap in particular may include a flange projection which cooperates with said first recess and head portion when the cap is fitted and in use urge the collar into engagement with said post.

Such an arrangement provides for a more secure gripping and securing of the post within the tubular main body and socket.

Preferably the collar comprises a post abutment surface which is adapted to provide, in use, an enhanced interference fit and grip on the said post against movement in a first direction as compared to movement in a second direction. The post abutment surface of said collar may comprises at least one serration or ridge. The at least one serration is preferably directionally orientated such that a first surface of said serration abuts said post and a different angle to a second surface of said serration.

Such an arrangement for the abutment surface of the collar allows the post to be more easily inserted into the collar than be removed from the collar.

The collar is preferably fabricated from a resilient material, for example a rubber material. The tubular body portion is preferably fabricated from an injection moulded plastic material, for example nylon.

The cap is preferably adapted to be snap fitted to said head portion. In particular the cap may include a flange lip which is cooperatively engaged with a cooperating flange lip on said head portion.

In an alternative construction, the cap may be dispensed with. The collar is replaced with a shock absorber element which, in use, covers the whole of the top of the head portion (apart where the shaft of the pole passes through). It is preferably held in place by the insertion of an expansion ring into a groove in the element thereby expanding it and causing it to grip the pole and seal against both the pole and the head portion. In this embodiment the pole is clamped by friction between itself, the collar and the head portion. Moreover, the collar seals against ingress of water into the body thus help reduce or prevent corrosion of the pole.

A further advantage of this construction is that the collar (element) and strengthening ring can be formed as a "cartridge" (with the element holding or partly encapsulating the ring) which can be inserted and removed as a unit very easily.

The reinforcing ring on its outer face is a close fit with the upper part of the main body. An impact on the pole is first transmitted to the shock absorber element which is then supported by the reinforcing ring, which in turn spreads the load into the main body and concrete foundation. The reinforcing ring is designed to be stronger than the pole which can catastrophically fail before any damage can occur to the main body. If damage occurred to the shock absorber element and/or the reinforcing ring, then these can effectively be replaced as a single cartridge.

The groove is preferably a circumferential groove which will accept a "C" shaped expansion ring. When a pole is placed into the post mounting arrangement, the expansion ring is driven into the groove. The ring expands the top of the shock absorber element so that the inner surface is clamped and sealed to the pole, gripping and retaining the pole. The outer face is thrust tightly to and sealed against the very top edge of the main body. The internal top edge of the main body may be provided with a reverse flange or lip which locates into a groove in the outer face of the shock absorber. Once the expansion ring is located in the groove, extreme force would be needed to separate the shock absorber from the main body.

The post and tubular main body portion may be of a generally circular, square or other cross section.

The present invention will now be described by way of example only with reference to the following figures in which.

Figure 1:
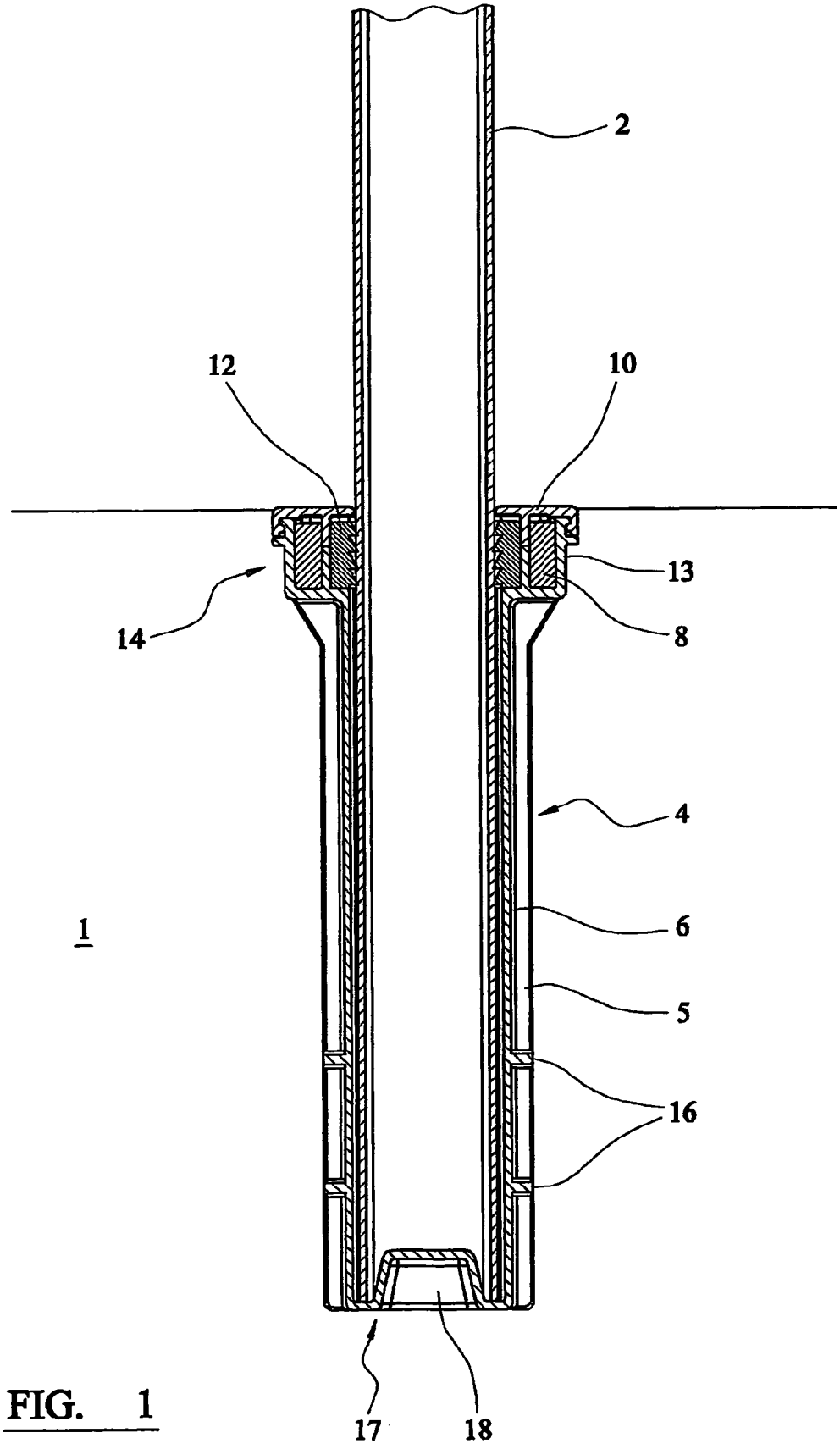
FIG. 1 is a cross sectional view through the post mounting arrangement and socket in accordance with an embodiment of the present invention.
Figure 2:
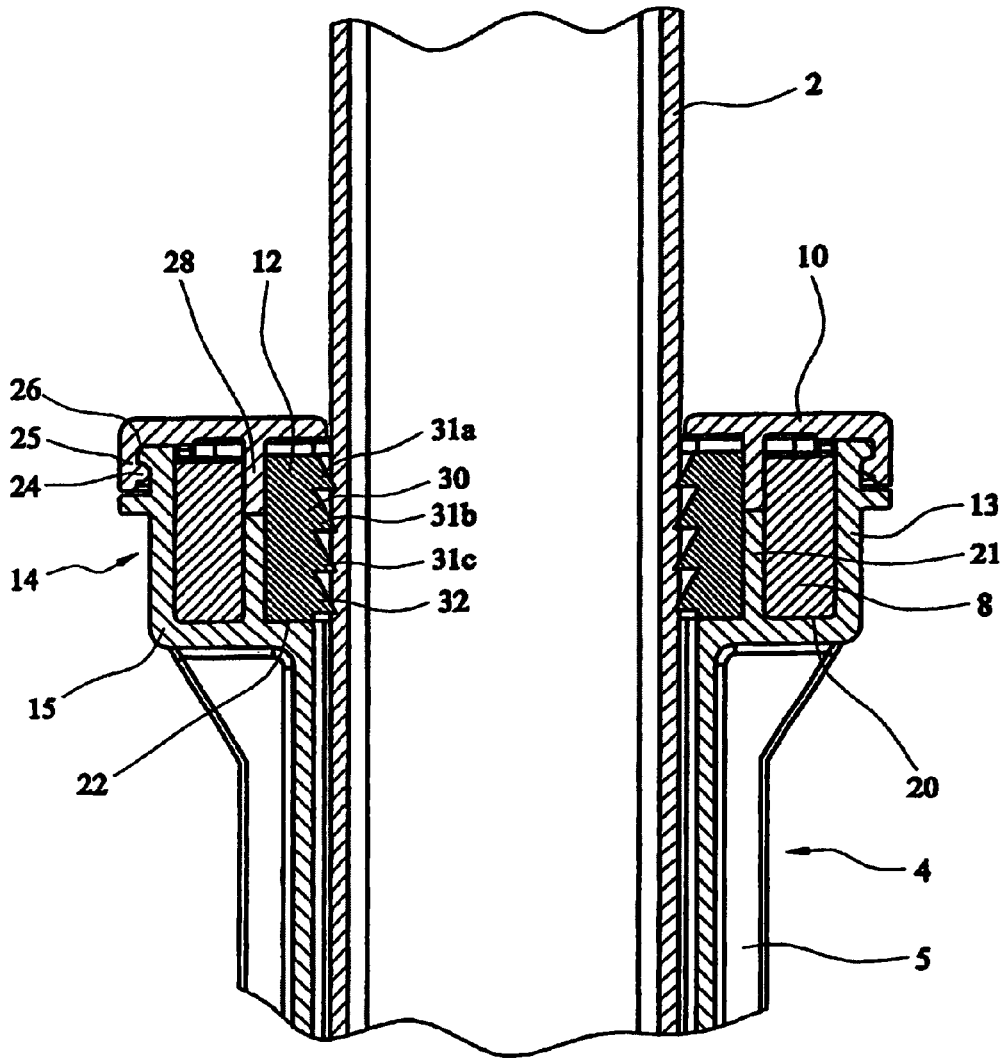
FIG. 2 is a more detailed cross sectional view of the head portion of the socket shown in FIG. 1.
Figure 6:
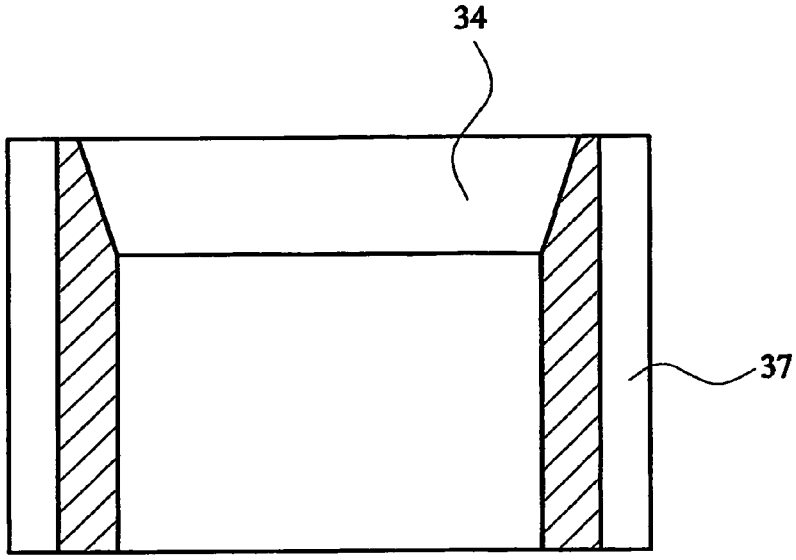
Figure 5:
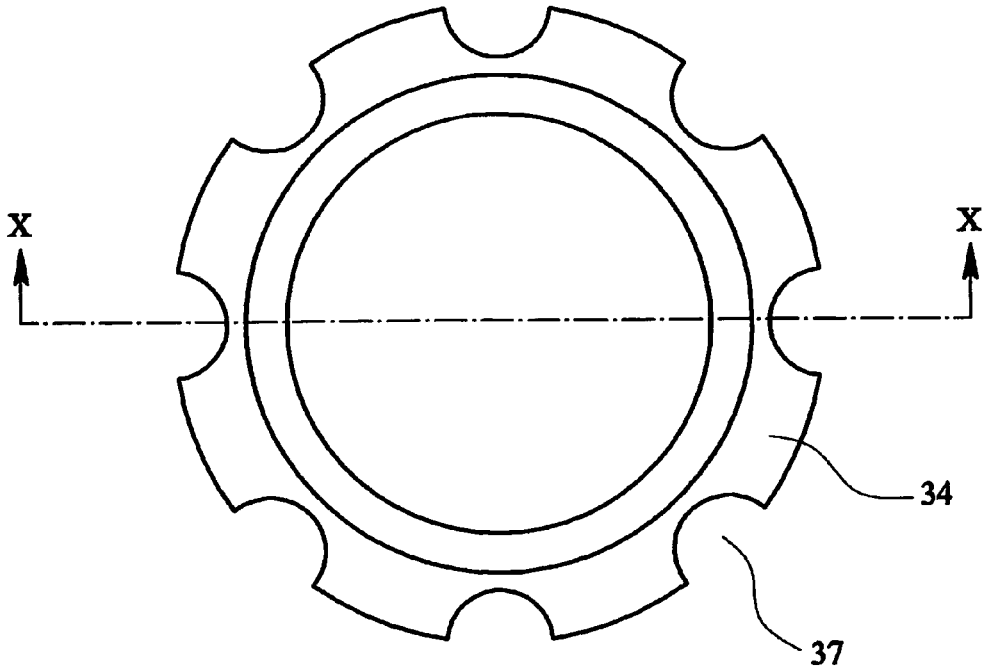
FIG. 5 is a plan view of a compliant shock absorber.
Figure 7:
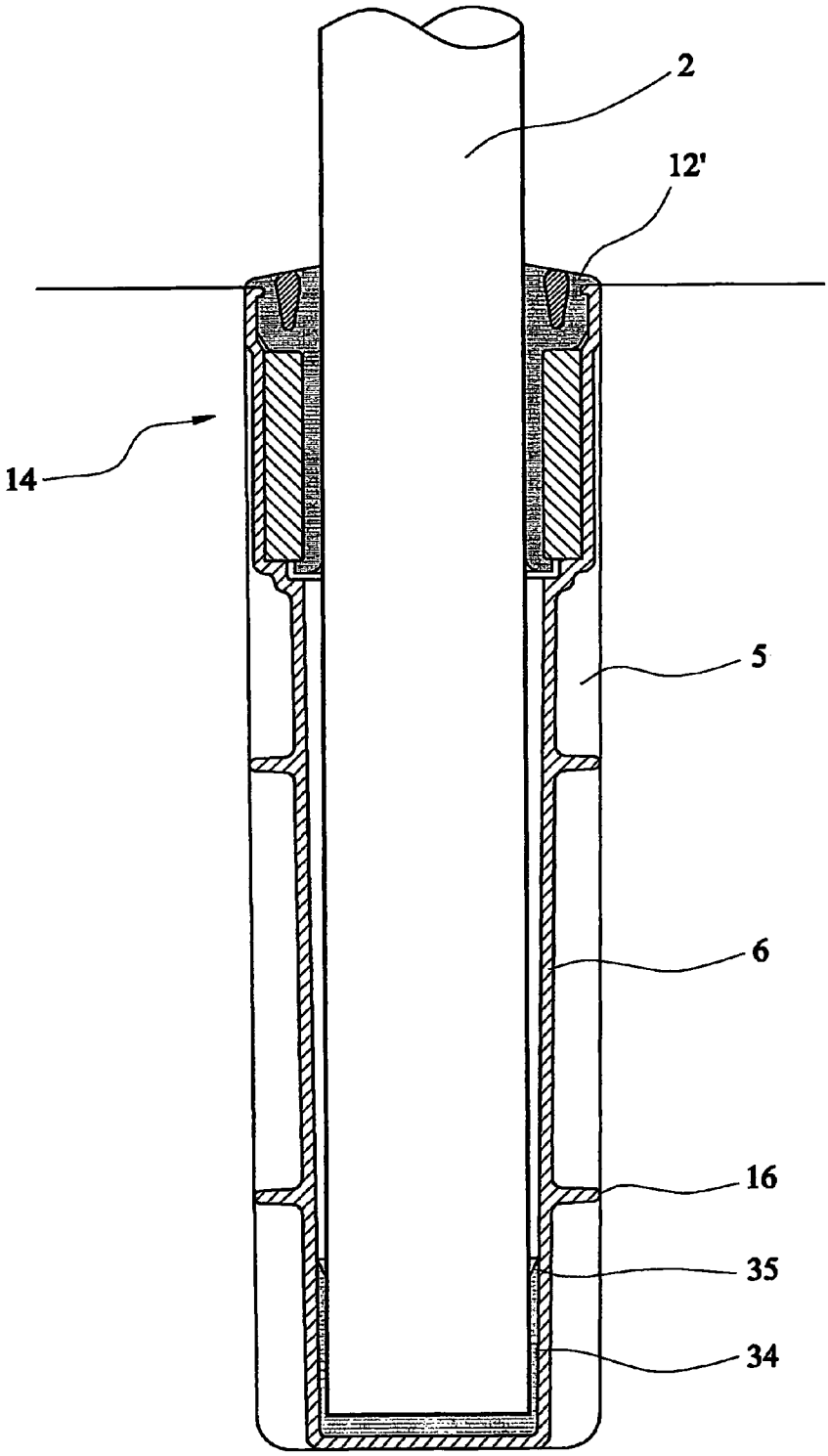
Figure 8:
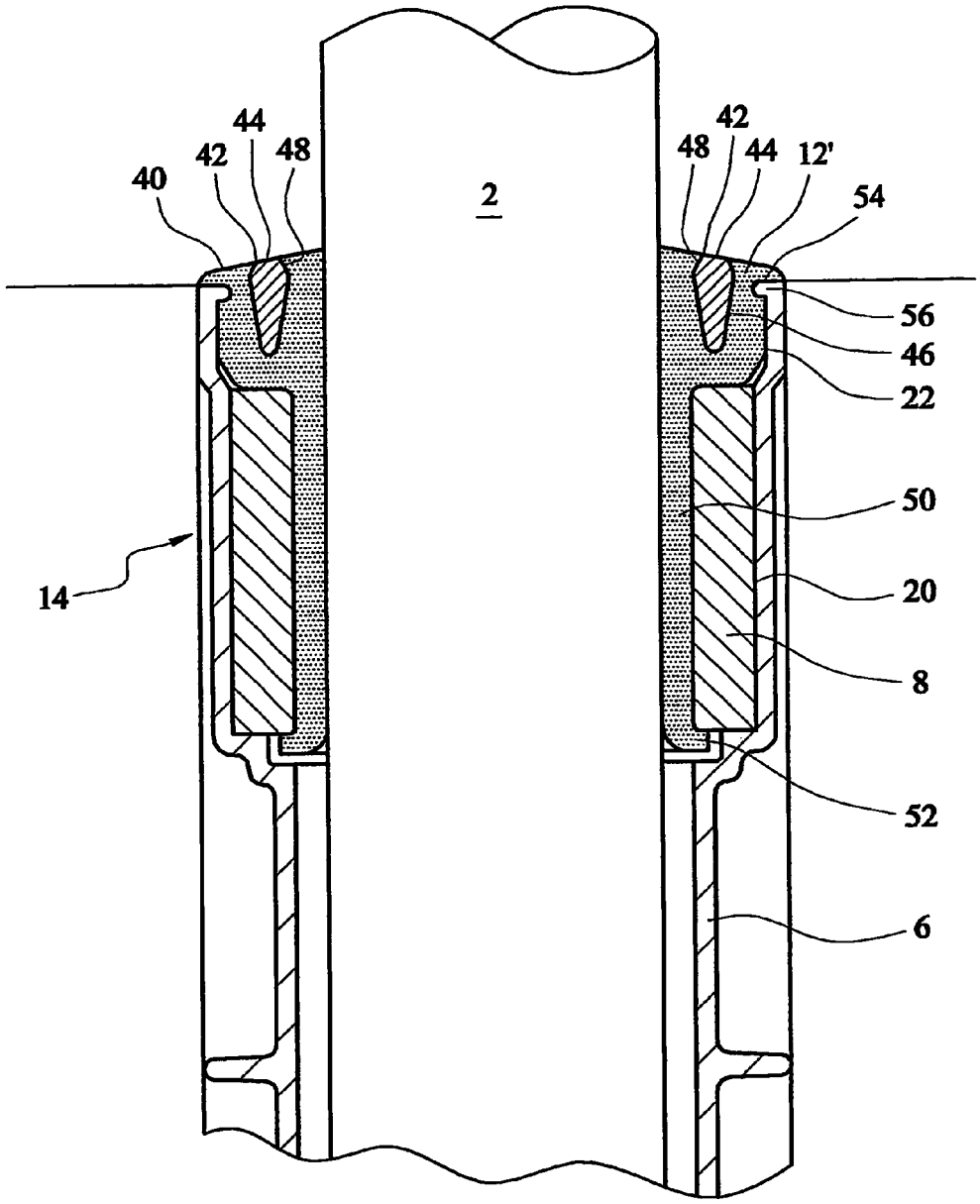

FIG. 6 a cross sectional view on line x—x of FIG. 5;

FIG. 7 is a similar view to FIG. 1 of another embodiment;

FIG. 8 is a similar view to FIG. 2 of the embodiment of FIG. 7; and

Figure 9:
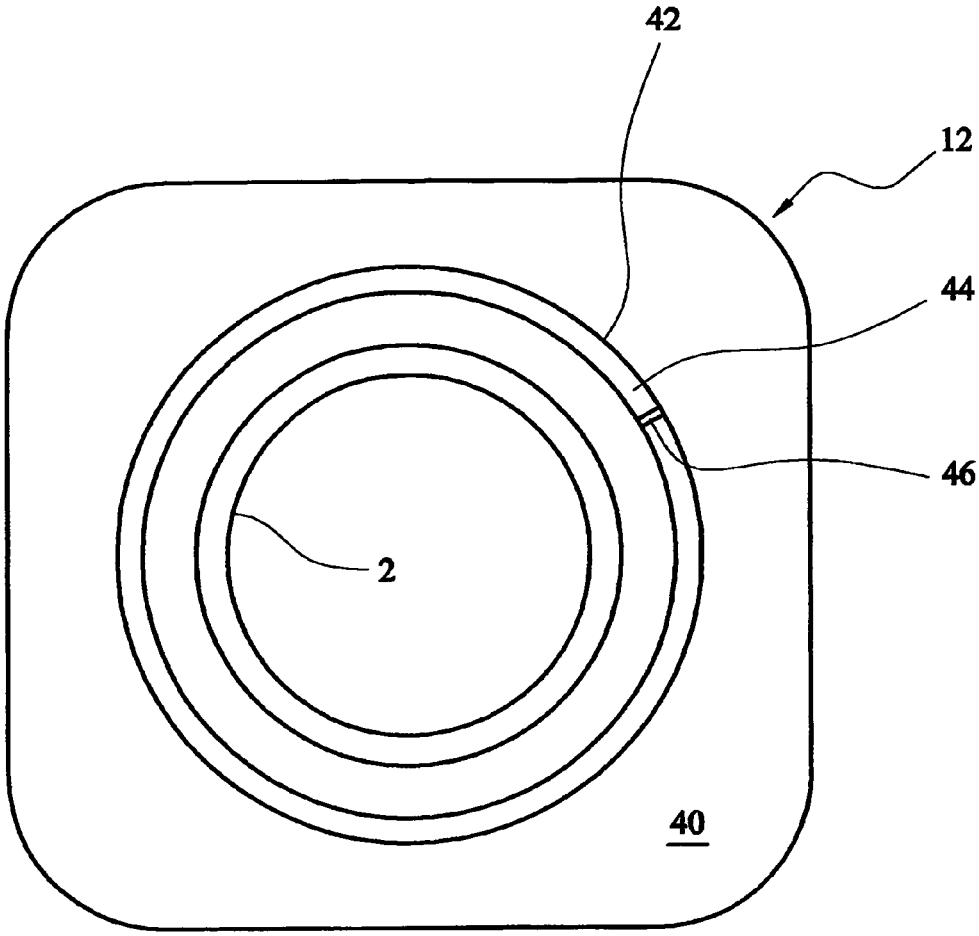

FIG. 9 is a plan view of the embodiment of FIG. 7.

Referring to FIGS. 1 and 2, there is shown a post mounting arrangement for mounting and securing a post (2) within the ground (1). The post (2) is associated with an item of street furniture, for example a traffic sign post, pedestrian guard rail leg post or mounting post for some other form of street furniture. It will be appreciated that there is a wide range of street furniture which is secured to the ground by way of one or more such mounting posts (2). Where a number of posts are to be secured, for example to mount a pedestrian guard rail fence, a series of such mounting arrangements can be disposed in the ground and along the street in order to secure a series of posts.

The post mounting arrangement comprises a post mounting socket assembly (4) which in use is installed within the ground (1) with a head portion (14) of the socket (4) generally flush with the ground level and the remainder of the socket (4) buried into the ground (1). A base end of a post (2) is fitted and secured into this socket (4) thereby securing and mounting the post (2) in the ground (1).

The socket assembly (4) comprises a main generally tubular main body portion (6). The tubular main body (6) defines an internal bore which corresponds to, although is slightly larger than, the outside diameter of the post (2) such that the post (2), in use can be easily inserted into the inner bore of the main body (6). In this embodiment the main body portion (6) is generally square and the post (2) is similarly of a square shape. It will be appreciated though that the main body (6) and post (2) could have other cross sectional shapes, for example cylindrical or rectangular in other embodiments.

Projecting from the outside of the main body portion (6) and spaced circumferentially around the outer circumference are a number of longitudinal ribs (5). Longitudinally spaced along the main body (6) there are also further circumferential ribs (16) which similarly project from the outside of the main tubular body (6). These ribs (5,16) strengthen the main tubular body (6). Also, when installed into the ground (1), the ribs (5,16) are held and engaged in the surrounding ground material surrounding the outside of the socket (4). This ensures that the mounting socket (4), when installed into the ground (1), is securely affixed into the ground (1) and restrained from twisting and/or being withdrawn vertically from the ground (1).

One end, the in use lower end, of the tubular main body (6) is closed off in order to prevent the ingress of ground material into the inside of the tubular main body (6) and also to provide an end stop for the base end of the post (2) when installed within the tubular main body (6). The closed end (17) of the main tubular body (6) comprises an upright stud projection (18) which projects longitudinally into the bore of the tubular main body (6). This stud projection (18) is concentric with the bore of the main tubular body (6) and is spaced radially from the inside of the bore. The side wall of the stud (18) is sloped and tapered inwardly with respect to the bore as the stud (18) projects into the bore. The base end of the post (2) is generally hollow and in use when the post (2) is fitted into the socket (4) the stud (18) engages the inside of the hollow base end of the tubular post (2). The tapering of the side wall of the stud (18) is configured such that there is a progressive interference fit and frictional engagement between the stud and post as the post is inserted vertically into the socket and onto the stud (18). The engagement of the stud with the post (2) locates and, in part secures the post (2) by friction into the socket (4).

The other open end of the tubular main body (6) and socket (4) comprises an enlarged head portion (14) in the form of an enlarged flange (15) projecting from and concentric with the main tubular body portion (6) and having an outer diameter greater than that of the main tubular body portion (6). This enlarged head portion (14) is shown in greater detail in FIG. 2.

Defined within the head portion (14) there is a first annular recess (22) concentric with the bore of the main tubular body (6). This recess (22) opens out inwardly onto the bore and in effect comprises a larger diameter bore portion of the bore of the main tubular body (6), and channel/groove, within the flange (14). An annular collar (12) is fitted and located within this first recess (22).

The annular collar (12) is fabricated from a resilient material, for example a rubber material such as for example EPDM (Ethylene Propylene Diene Monomer) a synthetic rubber. The inner diameter of the collar (12) is such that an inner surface of the collar tightly abuts against the outer surface of the installed post (2) such that there is a tight interference fit between the collar (12) and post (2). The annular collar (12), which itself is secured within the socket (4), grips and engages the outside of the post (2) thereby retaining and securing the post 2 within the socket (4). The inner surface (30) of the collar (12) includes a series of longitudinally spaced serrated circumferential ridges or teeth (31*a*,31*b*,31*c*) which project inwardly. The serrations (31*a*,31*b*,31*c*) are arranged and profiled such that they and the collar (12) provide greater resistance to longitudinal movement of the post (2) out of the socket (4) (i.e. upward) than to movement of the post (2) into the socket (i.e. downward). As shown, for example, in FIG. 2 the serrations (31*a*,31*b*,31*c*) have a triangular cross section and are arranged in a fir tree type arrangement in which an upper part of each serration (31*a*,31*b*,31*c*) is at a shallower tapering angle to the post (2) outer surface as compared to a lower portion of the each serration (31*a*,31*b*,31*c*). In this way the post (2) can be more easily installed into the socket (4) whilst removal of the post (2) from the socket (4), for example by a vandal, is made more difficult. In effect the collar (12) with the serrations (31*a*,31*b*,31*c*) provides a one way directional grip and enhanced interference fit upon the post(2). It will be appreciated though that other profiling of the collar (12) instead of the serrations (31*a*,31*b*,31*c*) illustrated could be used to provide this function in other embodiments.

Outwardly of the first recess (22) a second annular recess (20), in the form of a channel/groove formed in the end surface of the head portion (14), is defined within the head portion (14). The second recess (20) is similarly concentric with the bore of the main tubular body (6), and the first recess (22). This second recess (20) is radially separated from the first recess by a dividing wall portion (21) of the flange head portion (14). A strengthening band (8) in the form of an annular ring is located and fitted into the second recess (20). This strengthening or reinforcing band (8) is typically made from a material which is stronger than that of the remainder of the socket (4). Whilst the socket (4) could be fabricated from an injection moulded plastic material, for example a thermoplastic such a polypropylene, the strengthening band (8) could comprise 40% glass fibre reinforced compression moulded nylon material could be used for the strengthening band (8). The strengthening band (8) by virtue of its greater strength and also due to its continuous circumferential configuration, strengthens the upper region of the socket(4).

Upon the longitudinal distil end of the head flange portion (14) there is a cap (10).

Once fitted the cap (10) closes off the upper longitudinal ends of the first and second recesses (22,20). The cap (10) is arranged to secure the strengthening band (8) and collar (12) within the recesses (22,20), and ensure that they are properly engaged therein. The cap, when fitted to the socket (4), thereby prevents the strengthening band (8) and collar (12) from moving longitudinally (vertically upwards as shown) from and out of the socket (4).

The cap (10) comprises a generally planar disc member with a central hole defined therein. The central hole within the cap (10) generally corresponds to the outer diameter of the post (2) such that the post (2) can be fitted through the central hole in the cap (10) and into the bore of the socket (4). The cap (10) is arranged to securely engage and be fitted to the head portion (14). In this embodiment a peripheral flange wall (25) depends from the periphery of the cap (10). Around the distal end of this peripheral flange (25) there is an inwardly direct lip projection (24). This flange and lip (24) are arranged to be engaged against a cooperating outward lip projection (26) on the outer surface of the head portion (14). During assembly the cap (10) is 'snap-fitted' onto the head portion (14). The cap (10) is pressed longitudinally onto the end of the flange head portion (14). The lip (24) on the peripheral flange (25) of the cap (10) rides over and longitudinally beyond the lip (26) on the outside of the head portion (14) with the peripheral flange (25) of the cap (10) flexing outwardly slightly to allow this. The engagement of the two cooperating lip projections (24,26) then secures the cap (10) onto the end of the head portion (14). To remove the cap (10), for example to remove the post (2), the flange (25) of the cap (10) has to be prised outwards, using for example a screwdriver or other suitable tool, to allow the lip (24) to be eased back over the lip (26) on the head portion (14).

It will be appreciated that other alternative arrangements could be used to secure the cap (10) to the head portion (14). In particular, for example, fastening screws which are engaged within the head portion (14) could be used instead of or in addition to the snap fit arrangement. The use of fastening screws would provide a more secure engagement of the cap with the head portion although would add complexity to the arrangement. To prevent unauthorised removal the heads of the fastening screws could have a non standard shape such that a specific 'key' tool is required for the screws.

The dividing wall portion (21) of the head portion (14) between the first and second recesses (22,20), terminates short of the end of the longitudinal end of the head portion (14) and part way along the collar (12) and strengthening band (8). The cap (10) includes a further annular flange wall (28) projecting longitudinally from the cap (10). This flange wall (28), when the cap (10) is fitted to the head portion (14) fits, and is engaged, between the upper portion of the collar (12) and strengthening band (8) and continues the dividing wall portion (21) of the head portion (14). The fitting of the flange wall (28) between the collar (12) and strengthening band (8) when the cap (10) is fitted secures the upper portions of the strengthening band (8) and collar (12) radially in position within the socket assembly (4). This secures and further locks the strengthening band collar in position within the socket (4). In particular this also urges the collar (12) radially and increases the frictional engagement of the post (2) and collar (12) thereby increasing the grip on the post (2).

In use the socket (4) is seated at the bottom of a hole excavated in the ground (1) and concrete (or other filling material) is poured into the hole around the socket (4) and allowed to set to hold the socket (4) in place in the ground (1). The head portion (14) of the socket (4) is positioned substantially level with the ground level. The strengthening band (8) and collar (12) are then fitted into the respective recesses in the socket (4). Alternatively the strengthening band (8) and/or collar (12) may have already been fitted into the recesses (22,20) prior to installation of the socket (4) in the ground (1). The cap (10) is then fitted over the base of the post (2) with the post (2) passing though the central hole in the cap (10). The base of the post (2) is then inserted into and through the collar (12) and into the bore of the socket (4). The profiling and directional engagement of the serrations (31*a*,31*b*,31*c*) on the collar (12) mean that this insertion of the post (2) is relatively easy with the base of the post relatively easily passing through the collar (12). Furthermore, since the upper portion of the collar (12) is not restrained by the dividing wall (21), the upper part of the collar (12) can deflect outwards such that is not urged into engagement with the post (2) so further allowing easy insertion of the post (2) through the collar (12). The post (2) is inserted into the socket (4) until the base of the post (2) is engaged upon the stud (18) at the bottom end of the socket (4). With the post (2) installed within the socket (4), the cap (10) is then slid longitudinally down the post (2) and onto the end of the head portion (14) of the socket (4). The cap (10) is then pressed home and snap fitted onto the end of the head portion (14) of the socket (4). The cap (10) thereby secures and ensures that the strengthening band (8) and collar (12) are engaged within the recesses (20,22) and into the head portion (14) of the socket (4). The flange (28) of the cap (10), as the cap (10) is fitted, fits and is inserted between the upper part of the collar (12) and strengthening band (8). As the cap (10) is fitted this urges and presses the collar (12) inwards and further into engagement with the post (2). In this way the cap (10) secures and engages the collar (12) in place and within the socket (4) and thereby secures the post within the socket (4). The cap in effect when fitted, and by its engagement with the head portion (14) locks the strengthening band (8) and collar (12) in position within the socket (4) and the collar (12) into engagement with the post (2) to thereby secure the post (2) within the socket (4).

To remove the post (2), for example in the event of damage to the post (2) or street furniture which it mounts, the cap (10) is first prised way from and off the head portion (14) of the socket (4). The cap (10) can then be slid longitudinally upwards, away from and out of engagement with the socket(4). This releases the collar (12) from engagement within the head portion (14), opening the upper end of the recesses (20,22) and allowing the upper portion of the collar (12) to expand and/or move radially outwards. This unlocks the collar (12) (and also strengthening band (8) from engagement within the socket (4) and partially from engagement with the post (2). The post (2) is thereby at least partially released from the socket (4) and can be withdrawn from the socket (4). As the post (2) is withdrawn the post (2) either slides out from the collar (12) and/or the collar (12) slides out of the recess (22) in the socket (4) along with the post (2). In the later situation the collar can then separately be removed (if necessary by cutting) from the post (2).

Subsequently the original post (2), or a replacement post (2), may be reinstalled and inserted into the original socket (4) in a similar manner to that described above. If necessary a new collar (12) can be used and fitted into the socket (4). In this way the mounting posts are securely fixed into the ground (1) whilst they can be removed and replaced simply and easily without necessitating extensive digging and breaking up of the ground.

It will also be appreciated that with this arrangement the post (2) can be more securely locked in place by engagement of the separate cap (10) with the socket (4). In particular, tighter gripping collars can be used without adversely preventing authorised disassembly and removal of the post. Consequently removal of the post (2) by vandals casually pulling on the post (2) is substantially prevented, whilst the post (2) can be easily removed by suitably equipped personnel first removing the cap (10) to release the post (2) and collar (12) from the socket (4).

The use of a removable separate cap to secure and lock the collar (12) into the socket (4), also allows the use of a directionally engaged and gripping collar (12) which more securely and tightly grips the post (2) from removal than against insertion of the post. The use of such a directional gripping collar (12) is problematic with conventional arrangements since it makes authorised removal similarly difficult.

Additionally, by using a separate cap (10) which locks and urges the collar into further engagement with the post also further improves the gripping of the post whilst again not adversely affecting authorised removal of the post.

A further advantage of this arrangement is that the collar, strengthening band, and cap can all be individually replaced in the event of damage. If for example the post or street furniture which it mounts is hit be a vehicle a high impact load is applied to the head portion (14) of the socket (4) with the post (2) typically pivoting about the head (14) of the socket (2) about which the post (2) is mounted into the ground. In particular this impact load is most likely to cause the strengthening band (8), which reinforces the head portion (14) to fracture. With previous arrangements, the fracture or damage of the strengthening band or reinforcement embedded within the socket (4) would necessitate digging up of the ground and removal and of the entire socket (4). In contrast with this arrangement, the main socket (4) can be left in place and the strengthening band simply replaced within the recess (20). Similarly, if the cap (10) or collar is damaged they can also be individually and easily replaced.

A yet further advantage of this arrangement is that it is considerably easier to fabricate than the prior arrangements. The socket (4) and cap is preferably made from injection moulded plastic. The strengthening band (8) and collar (12) are then installed as separate items within the finished moulded socket. It will be appreciated that the moulding of the socket without an embedded strengthening band (8) is considerably more straightforward than, as with the prior arrangements, having to mould the socket with an embedded band (8). Separate materials, optimised for the individual parts can also more readily be used since the various parts (socket body, strengthening band (8), collar (12) and cap (10)) are separate and discrete parts. For example, in the described embodiment the main tubular body (6) and main part of the socket are made from injection moulded polypropylene. This is easy to injection mould. The strengthening band (8) is made from 40% glass (either glass fibre or glass) reinforced compression moulded nylon to provide good strength. The collar is made from a EPDM, a synthetic rubber, to provide high frictional engagement and also a degree of resilience to securely grip the post. It will be appreciated though that other suitable materials and comminations of materials could be used in other embodiments.

Figure 3:
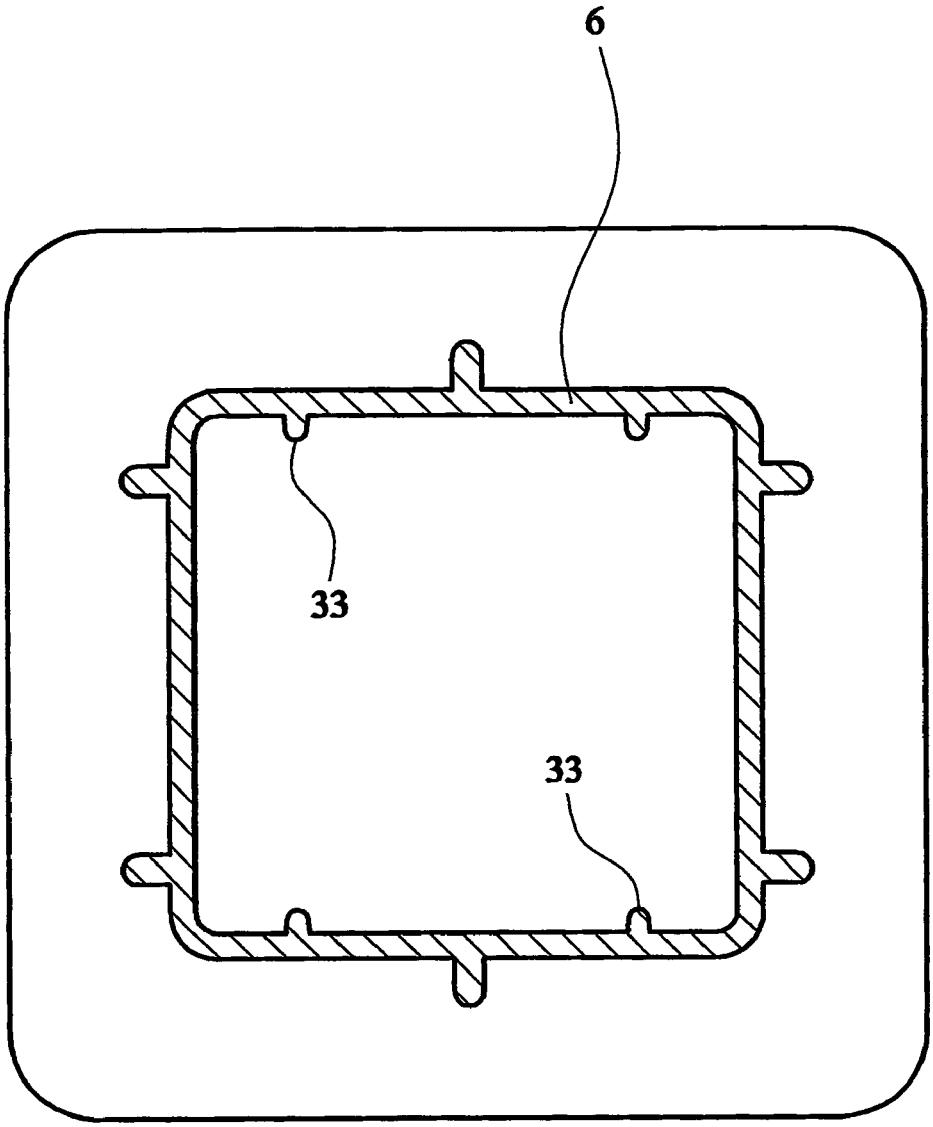
FIG. 3 is a cross-sectional view of the tubular main body.

Referring now to FIG. 3, the tubes used in a typical application are manufactured to generous tolerances and to provide a means for accommodating these variations the bore of the tubular main body portion (6) has been provided with a number (dependant on tube cross sectional shape of the tube) of longitudinal ridges (33), reference FIG. 3 (which is a cross sectional view of the tubular main body (6) suitable to receive a square section tube). The peaks of the ridges (33) represent the minimum size of the tube and if a slightly larger tube is fitted, then as it is forced into the tubular main body (6) it shaves the required amount off the peak of the ridges (33) to create a hole of dimensions that correspond to that particular tube. In variations of the pole housing that require higher levels of shock absorbency, this feature may be omitted.

In the original design, when the pole (2) is subjected to an impact the collar (12), which is made of a compliant material, is deformed to some degree and as this occurs energy is absorbed. The absorption of energy reduces the peak load applied to the pole by the impact and will either reduce the damage to the pole or could prevent structural failure of the pole.

To provide a degree of shock absorption it is necessary to allow the component being subjected to an impact to move a distance whilst simultaneously providing a resistance to the impact. This is based on the theory that work done is equal to force multiplied by distance travelled. In the case of the pole housing, the pole, when subjected to an impact, should be allowed to move whilst generating a force resisting that movement. Ideally, the optimum force produced should be only slightly less that the force necessary to cause failure of the pole.

Figure 4:
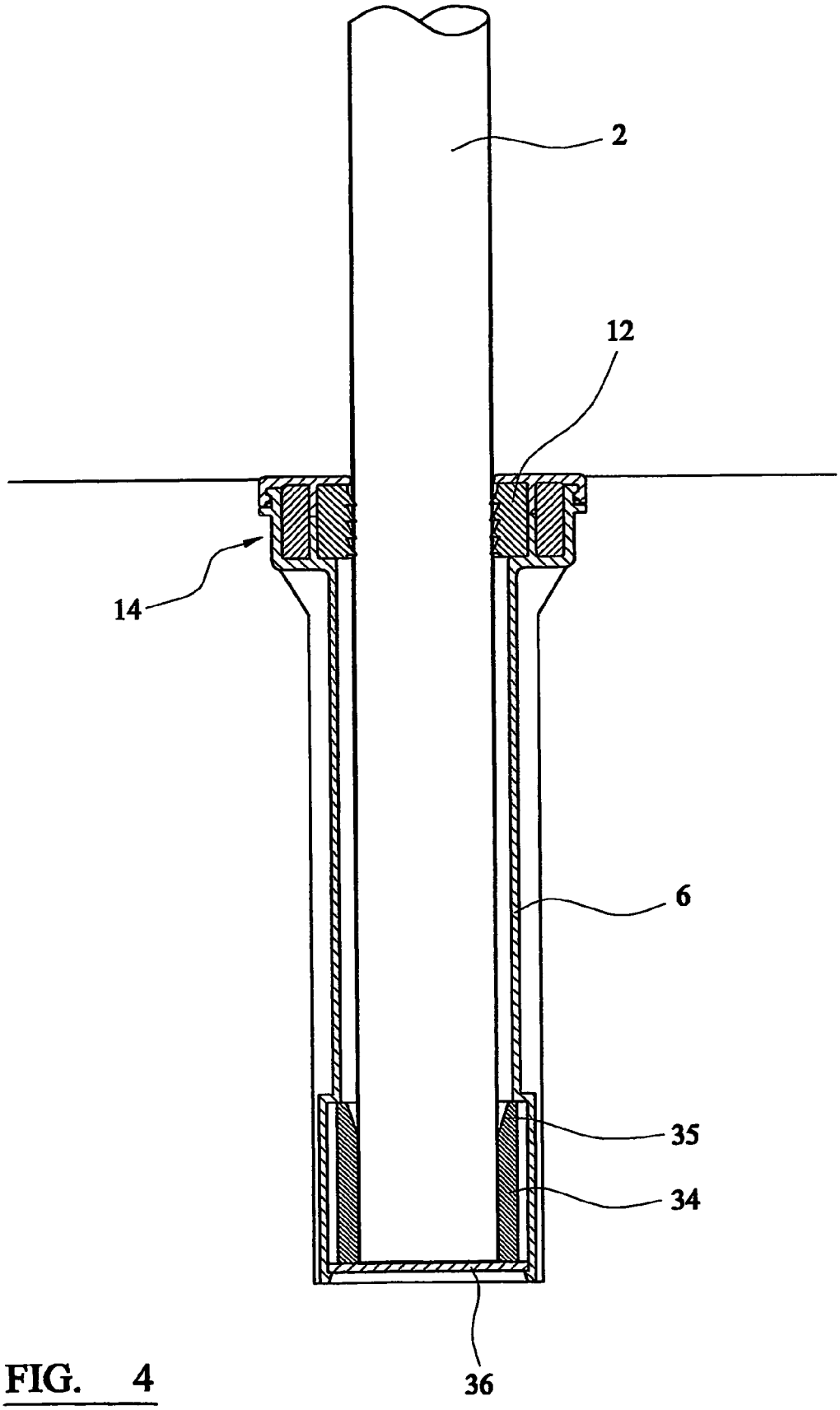
FIG. 4 is a similar view to FIG. 1 of another embodiment.

Referring now to FIGS. 4–6, the head portion (14) essentially remains as previously described with the exception that the pole (2) is allowed to move more within the collar (12) to increase the amount of shock absorption. In the base of the main tubular body (6) a compliant bush (34) is housed and retained in position by a cap (36) which is a snap fit into the base of the main tubular body (6). The pole (2) is a slide fit into the compliant bush (6) which firmly locates pole (2). The bush (34) has a chamfer (35) to aid location and retention of the pole. In the event of an impact to the pole (2), the bush (6) and collar (12) permit the pole to move whilst providing a considerable resistance to the movement and hence absorbing the impact load. The compliant bush (34) can have the force it produces to resist the impact load modified by varying the properties of the compliant material, such as hardness, and by changing the cross sectional profile. FIGS. 5 and 6 show compliant bush (34) with grooves (37) around the periphery. These have the effect of reducing the resistance to the impact. Different applications will employ tubes of different strengths and it is important to be able to adjust the properties of both the collar (12) and compliant bush (34) to achieve maximum shock absorption. The bush is replaceable.

Referring now to FIGS. 7–9, a further, and currently preferred, embodiment of the invention will be described using like numerals for like parts. The principal change in this embodiment is that the cap (10) is dispensed with and the collar (12) is replaced with a shock absorbing element (12') of a similar resilient material, such as an elastomer (EPDM). It has inclined top surfaces (40) to shed water away from the pole (2). Incorporated into the inclined top surface (40) is a circumferential groove (42) capable of accepting an expansion ring (44), typically made of a plastics material such as nylon. The expansion ring (44) is "C"-shaped, and has a split (46) (FIG. 9). This enables it to have one end inserted into the groove (42) and for the remainder of the ring then to be progressively forced into the groove. This arrangement permits higher insertion forces to be generated and also permits a tool to be inserted into the split (46) to remove the ring when necessary. The cross-sectional shape of the expansion ring (44) is generally wedge shaped (46) to aid penetration into the groove and to exert expansion forces on it. In order that the expansion ring (44) may be retained once inserted into the groove (42), its top edges (48) taper at a steeper angle than the wedge shape (46), thus acting to retain the ring in the groove.

As can be seen from FIG. 9, only a small part of the expansion ring (44) is visible from the top of the head portion and a special insertion tool is required to achieve removal. It is thus not obvious how the pole (2) is retained in the mounting arrangement and this, combined with the need for a special tool, makes it difficult for vandals to remove the pole (2).

The strengthening band (8) in this embodiment is retained in the recess (20), and passing through the bore of the strengthening band (8) is a liner sleeve (50) which is an extension of the shock absorber element (12'). The lower end of the liner sleeve (50) is provided with a lip (52) which retains the two components together, and when combined with the strengthening band (8) the two form a "cartridge" enabling them to be inserted and removed as a single unit.

The top of the collar (12') interlocks with the top of the head portion (14) by means of a groove (54) in the collar and corresponding lip (56) of the top of the head portion (14).

In use, the "cartridge" comprising the collar (12') and strengthening band (8) (but without the expansion ring (44) in place) is slipped over the pole (2) and the pole inserted into the bore (6). As before, the base of the pole locates by means of a chamfer (35) into the bush (34). The cartridge is pushed downwardly until the collar (12') locates on top of the head portion (14) with the lip (56) engaging in the groove (54). The expansion ring (44) is then forced into the circumferential groove (42), causing the top of the collar (12') to expand and press against both the post (2) and the top of the wall of the head portion (14). The tightness achieved by the insertion of the expansion ring (44) creates a seal and locks the shock absorber element (12') to both the main body portion (14) and the post (2). If, as shown in FIG. 9, the outer face of the main body is square, then when the shock absorber element (12') is locked into place by the expansion ring it is not possible to rotate it.

The strengthening band (8) is typically made of a glass fibre reinforced nylon material and is a slide fit into its recess (20) in the tubular portion (6).

In situations where the pole (2) has received an impact sufficient to cause failure, the expansion ring (44) is removed and the pole (2) and collar (12')/strengthening band (8) "cartridge" can be removed from the tubular portion (6) which will not be damaged. It is then a simple task to replace the pole (2) together with a new cartridge.

Whilst the above arrangement has been described with reference to a single post mounting, it will be appreciated that the same principles can be applied to a single double socket arrangement in which two posts can be mounted within the same socket assembly. In such a case, the socket assembly would comprise two internal bore sections and two collars (possibly joined into a single element). Similarly a single multiple post socket could also be produced.

The invention claimed is:

1. A post mounting arrangement for ground installation of a post, comprising a tubular body portion which is adapted to be installed into the ground and has an open end adapted to receive a post to be supported, the open end of the tubular body portion comprising an enlarged flange portion defining a head portion of the tubular main body portion, the head flange portion includes a resilient retaining collar adapted to receive and engage the post, and a strengthening band; wherein the head portion comprises a first recess defined therein within which the said collar is engaged and mounted, a second recess defined in the head portion adapted to receive the said strengthening band, and the whole being adapted to be fitted to and engage with the post to enclose the tubular body portion and secure the post and strengthening band, the collar and band being removable.

2. An arrangement as defined in claim 1, wherein a cap is provided adapted to be fitted to and engage with said head portion to enclose the recesses and secure the collar and strengthening band in place.

3. A post mounting arrangement as claimed in claim 2 in which the cap when engaged and fitted to the head portion is adapted to urge the collar inwards, in use, into engagement with the post.

4. A post mounting arrangement as claimed in claim 2 in which said cap includes a portion which is adapted, when said cap is fitted to said head portion, cooperates with said first recess to urge said collar, in use into engagement with said post.

5. A post mounting arrangement as claimed in claim 4 in which said cap includes a flange projection which cooperates with said first recess and head portion to when the cap is fitted and in use urge the collar into engagement with said post.

6. A post mounting arrangement as claimed in claim 2 in which the collar comprises a post abutment surface which is adapted to provide, in use, an enhanced interference fit and grip on the said post against movement in a first direction as compared to movement in a second direction.

7. A post mounting arrangement as claimed in claim 6 in which said post abutment surface of said collar comprises at least one serration or ridge.

8. A post mounting arrangement as claimed in claim 7 in which said at least one serrations is directionally orientated such that a first surface of said serration abuts said post and a different angle to a second surface of said serration.

9. A post mounting arrangement as claimed in claim 2 in which said cap is adapted to be snap fitted to said head portion.

10. A post mounting arrangement as claimed in claim 9 in which said cap includes a flange lip which is cooperatively engaged with a cooperating flange lip on said head portion.

11. An arrangement as claimed in claim 1, wherein the collar comprises a shock absorber element having a groove capable of receiving an expansion ring to lock the element into place.

12. An arrangement as claimed in claim 11, wherein the shock absorber element, in use, covers and seals the whole of the top of the head portion.

13. An arrangement as claimed in claim 11, wherein the element interlocks with the top of the head portion.

14. An arrangement as claimed in claim 11, wherein the strengthening band is retained between the second recess and an extended sleeve portion of the element.

15. A post mounting arrangement as claimed in claim 1, in which the post and tubular main body portion are of a generally circular cross section.

16. A post mounting arrangement as claimed in claim 1 in which the post and tubular main body portion are of a generally square or rectangular cross section.

17. A post mounting arrangement as claimed in claim 1 in which said first recess defined in said head portion is adapted such that said collar can flex away from, in use, engagement with said post.

18. A post mounting arrangement as claimed in claim 1 in which the collar is fabricated from a resilient material.

19. A post mounting arrangement as claimed in claim 18 in which said collar is fabricated from a rubber material.

20. A post mounting arrangement as claimed in claim 1 in which said tubular body portion is fabricated from an injection moulded plastic material.

21. A post mounting arrangement as claimed in claim 20 in which said plastic material comprises polypropylene.

22. A Method of erecting a post using a post mounting arrangement as claimed in claim 1, comprising the steps of:

installing said tubular main body in the ground, installing said strengthening band in said second recess, installing said collar in said first recess, inserting a base end of said post through said collar and into said tubular body portion, and fitting said cap to said head portion to secure said collar within said head portion, or inserting said expansion ring into the shock absorbing element.

23. A Method of erecting a post as claimed in claim 22 in which said post is inserted through said collar prior to installing said collar and inserting said post into said main tubular body.

* * * * *